US006622771B2

(12) United States Patent
Plockmeyer

(10) Patent No.: US 6,622,771 B2
(45) Date of Patent: Sep. 23, 2003

(54) ARCUATELY DISPLACEABLE PRIVACY SCREEN ASSEMBLY

(75) Inventor: Charles R. Plockmeyer, Holland, MI (US)

(73) Assignee: Xibitz, Inc., Grand Rapids, MI (US)

( * ) Notice: Subject to any disclaimer, the term of this patent is extended or adjusted under 35 U.S.C. 154(b) by 0 days.

(21) Appl. No.: 09/971,450

(22) Filed: Oct. 5, 2001

(65) Prior Publication Data

US 2003/0051832 A1 Mar. 20, 2003

Related U.S. Application Data

(60) Provisional application No. 60/322,118, filed on Sep. 14, 2001.

(51) Int. Cl.[7] ..... E06B 9/00

(52) U.S. Cl. ..... 160/352; 160/135; 160/371; 114/39.21

(58) Field of Search ..... 160/135, 237, 160/351, 352, 371, 377; 114/39.2, 98, 102; 135/87, 904

(56) References Cited

U.S. PATENT DOCUMENTS

| | | | | | |
|---|---|---|---|---|---|
| 2,900,870 | A | * | 8/1959 | Jackson | 160/352 X |
| 2,911,038 | A | * | 11/1959 | Frommelt | 160/351 X |
| 3,875,953 | A | * | 4/1975 | Couix | 135/4 A |
| 3,995,799 | A | * | 12/1976 | Bartolini | 244/16 |
| 4,365,570 | A | * | 12/1982 | Jamieson | 114/39 |
| 4,407,319 | A | * | 10/1983 | Shultz et al. | 135/87 |
| 5,272,848 | A | * | 12/1993 | Maas | 52/238 |
| 5,423,276 | A | * | 6/1995 | Nishimura | 114/39.2 |
| 5,553,648 | A | * | 9/1996 | Goharjou | 160/135 |
| 5,730,666 | A | * | 3/1998 | Hudson | 473/421 |
| 6,206,079 | B1 | * | 3/2001 | Selgrad | 160/351 |
| 6,332,284 | B1 | * | 12/2001 | Tafforeau | 40/603 |
| 2002/0043352 | A1 | * | 4/2002 | Stannis et al. | 160/371 |

* cited by examiner

*Primary Examiner*—Bruce A. Lev
(74) *Attorney, Agent, or Firm*—King & Jovanovic, PLC

(57) ABSTRACT

An arcuately displaceable privacy screen assembly, comprising: (a) a frame sub-assembly having an internal aperture contained therein, wherein at least a portion of the internal aperture is covered with a privacy screen; and (b) at least two ground engaging wheels associated with the frame sub-assembly, wherein the at least two ground engaging wheels controllably direct displacement of the privacy screen in an arcuate path of travel.

14 Claims, 9 Drawing Sheets

ARCUATELY DISPLACEABLE PRIVACY SCREEN ASSEMBLY

CROSS-REFERENCE TO RELATED APPLICATION(S)

This application claims the benefit of U.S. Provisional Application Ser. No. 60/322,118, filed Sep. 14, 2001, the entirety of which is hereby incorporated herein by reference.

BACKGROUND OF THE INVENTION

Field of the Invention

The present invention relates in general to a privacy screen, and more particularly, to an arcuately displaceable privacy screen assembly having a structural configuration which, among other things, allows a user to arcuately displace a privacy screen with substantial ease, safety, and convenience.

Partitions and/or dividing panels have been known in the art for several years. Furthermore, partitions and/or dividing panels for use as office furniture have likewise been known in the art. While such conventional partitions and/or dividing panels do appear to provide a means for creating privacy by partitioning and/or dividing space, their configurations remain non-desirous and/or problematic inasmuch as, to Applicant's knowledge, none are conducive to arcuate displacement with substantial ease, safety, and convenience. Among other reasons, their direction of displacement appears to be linear which requires the user to controllably actuate and/or direct arcuate displacement of the partition when an arcuate path is desired around, for example, the user or user's work station. Furthermore, conventional partitions and/or dividing panels appear to be heavy and/or difficult to slide on a variety of floor coverings.

A second problem associated with conventional partitions and/or dividing panels relates to their safety. Inasmuch as conventional partitions and/or dividing panels are substantially linear and upright by design, an irregular or unexpected force may alter the substantially upright configuration of the partition or dividing panel. Moreover, the configuration of the wheels, or, for example, the casters often used, typically protrude well beyond the base of the partition or dividing panel, thereby producing both a safety hazard for those walking by as well as an inconvenient, bulky shape for storage or overlapping of two or more conventional partitions and/or dividing panels.

In addition, conventional partitions and/or dividing panels may not be convenient for a plurality reasons. First, their structures are not favorable for inexpensive cleaning or replacement of a section of the partition or panel. Second, configurations of such conventional partitions and/or dividing panels may require many components such as handles, wheels, or attachments, for example, which do not enable users to effectively nest them together for storage or for an extension of the desired area of privacy.

It is therefore an object of the present invention, to provide an arcuately displaceable privacy screen assembly which, among other things, remedies the aforementioned detriments and/or complications associated with the use of the above-identified devices.

SUMMARY OF THE INVENTION

The present invention is directed to an arcuately displaceable privacy screen assembly comprising: (a) a frame sub-assembly having an internal aperture contained therein, wherein at least a portion of the internal aperture is covered with a privacy screen; and (b) at least two ground engaging wheels associated with the frame sub-assembly, wherein the at least two ground engaging wheels controllably direct displacement of the privacy screen in an arcuate path of travel.

In a preferred embodiment of the present invention, the at least two ground engaging wheels are configured in a fixed position.

In another preferred embodiment of the present invention, one of the at least two ground engaging wheels is fixed in a substantially parallel position relative to a first end of a first substantially horizontal frame member and a second ground engaging wheel is fixed in a substantially parallel position relative to a second end of the first substantially horizontal frame member.

Preferably, the at least two ground engaging wheels are configured substantially inline relative to the first substantially horizontal frame member.

In accordance with the present invention, the arcuately displaceable privacy screen assembly further comprises means for biasing the arcuately displaceable privacy screen assembly in a substantially upright configuration.

In a preferred embodiment of the present invention, the arcuately displaceable privacy screen assembly further comprises at least one handle associated with both a first substantially vertical frame member and a second substantially vertical frame member. In this embodiment, the at least one handle may be cambered to, in turn, form an ogive with the first substantially horizontal frame member when viewed from a y-axis of the same.

In yet another preferred embodiment of the present invention, the arcuately displaceable privacy screen assembly further comprises at least one stabilizing member associated with the first substantially horizontal frame member and the first substantially vertical frame member.

The present invention is further directed to an arcuately displaceable privacy screen assembly comprising: (a) a frame sub-assembly having an internal aperture contained therein, wherein at least a portion of the internal aperture is covered with a privacy screen; (b) at least two ground engaging wheels associated with the frame sub-assembly, wherein one of the at least two ground engaging wheels is fixed in a substantially parallel position relative to a first end of a first substantially horizontal frame member and a second ground engaging wheel is fixed in a substantially parallel position relative to a second end of the first substantially horizontal frame member; (c) at least one handle associated with both a first substantially vertical frame member and a second substantially vertical frame member; and (d) at least one stabilizing member associated with the first substantially horizontal frame member and the first substantially vertical frame member.

The present invention is also directed to an arcuately displaceable privacy screen assembly comprising: (a) a frame sub-assembly, wherein the frame sub-assembly includes first and second substantially vertical frame members and first and second substantially horizontal frame members, wherein both of the first and second substantially horizontal frame members are cambered, and wherein the first and second substantially vertical frame members and the first and second substantially horizontal frame members collectively define an internal aperture, wherein at least a portion of the internal aperture is covered with a privacy screen; and (b) at least two ground engaging wheels associated with the frame sub-assembly, wherein the at least two ground engaging wheels controllably direct displacement of the privacy screen in an arcuate path of travel.

Furthermore, the present invention is directed to an arcuately displaceable privacy screen assembly comprising: (a) a frame sub-assembly, wherein the frame sub-assembly includes first and second substantially vertical frame members and first and second substantially horizontal frame members, wherein both of the first and second substantially horizontal frame members are cambered, and wherein the first and second substantially vertical frame members and the first and second substantially horizontal frame members collectively define an internal aperture, wherein at least a portion of the internal aperture is covered with a privacy screen; (b) at least two ground engaging wheels associated with the frame sub-assembly, wherein the at least two ground engaging wheels controllably direct displacement of the privacy screen in an arcuate path of travel, and wherein one of the at least two ground engaging wheels is fixed in a substantially parallel position relative to a first end of the first substantially horizontal frame member and a second ground engaging wheel is fixed in a substantially parallel position relative to a second end of the first substantially horizontal frame member; (c) at least one handle associated with both the first substantially vertical frame member and the second substantially vertical frame member, wherein the at least one handle is cambered to, in turn, form an ogive with the first substantially horizontal frame member when viewed from a y-axis of the same; and (d) a first stabilizing member associated with the first substantially horizontal frame member and the first substantially vertical frame member and a second stabilizing member associated with the first substantially horizontal frame member and the second substantially vertical frame member.

BRIEF DESCRIPTION OF THE DRAWINGS

The invention will now be described with reference to the drawings wherein.

DETAILED DESCRIPTION OF THE INVENTION

Figure 1:
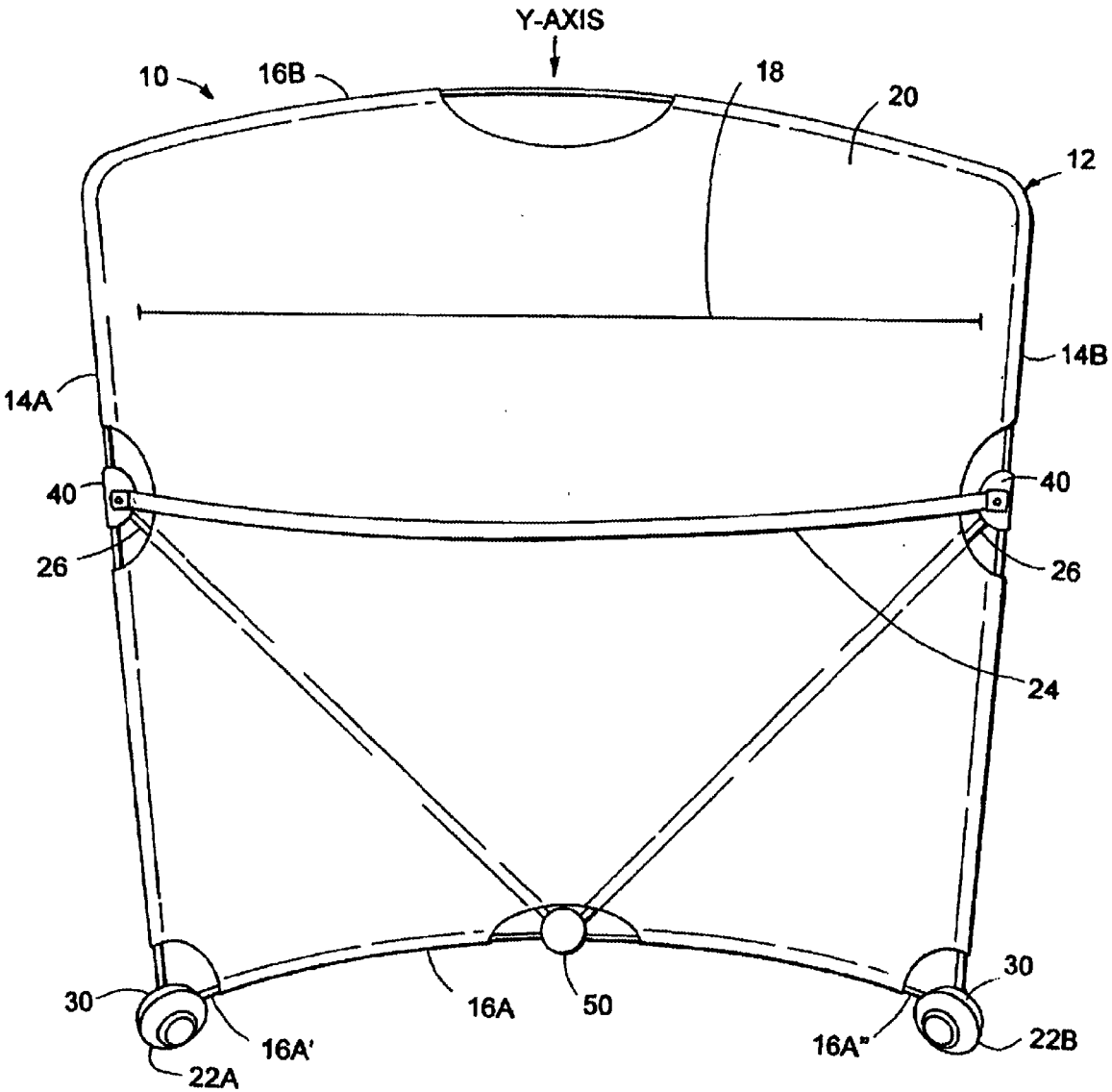
FIG. 1 of the drawings is a perspective front view of an arcuately displaceable privacy screen assembly fabricated in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings, and to FIGS. 1–5 in particular, perspective representations of a first embodiment of arcuately displaceable privacy screen assembly 10 are shown, which generally comprises frame sub-assembly 12, containing an internal aperture 18 which is at least partially covered by privacy screen 20, and at least two ground-engaging wheels 22A and 22B. It will be understood that FIGS. 1–5 are merely representations of arcuately displaceable privacy screen assembly 10. As such, some of the components may be distorted from their actual scale for pictorial clarity.

For purposes of the present disclosure, frame sub-assembly 12 generally comprises first and second substantially vertical frame members 14A and 14B as well as first and second substantially horizontal frame members 16A and 16B. It will be understood, however, that frame sub-assembly 12 may be fabricated from a unitary frame member, or, alternatively from a plurality of frame members, such as two-piece, three-piece, four-piece, five-piece, etcetera, frame members. For example, first substantially vertical frame member 14A may be molded to, or a part of, second substantially horizontal frame member 16B, which, in turn, may be molded to, or a part of, second substantially vertical frame member 14B, collectively forming a substantially inverted-U-shaped, unitary member which is associated with first substantially horizontal frame member 16A to form frame assembly 12. Alternatively, an upper portion of first substantially vertical frame member 14A may be molded to, or a part of, second substantially horizontal frame member 16B, which, in turn, may be molded to, or a part of, an upper portion of second substantially vertical frame member 14B, collectively forming a substantially inverted-U-shaped, unitary member. A lower portion of first substantially vertical frame member 14A may then be secured to the upper portion of first substantially vertical frame member 14A and a lower portion of second substantially vertical frame member 14B may then secured to the upper portion of second substantially vertical frame member 14B, both of which may be secured to first substantially horizontal frame member 16A to form frame sub-assembly 12.

Frame sub-assembly 12 may be fabricated from natural and/or synthetic resins, plastics, woods, metals, composites, and/or combinations thereof. In a preferred embodiment, frame sub-assembly 12 comprises a tubular metal, such as tubular aluminum. In another preferred embodiment, frame sub-assembly 12 comprises an outer peripheral geometry which is at least partially embraced by an outer edge portion of privacy screen 20. As such, frame sub-assembly 12 may comprise a substantially circular outer peripheral geometry, however, it will be understood that any one of a number of peripheral geometries are likewise contemplated for use. Likewise, while frame sub-assembly 12 has been disclosed as having an outer peripheral geometry which is substantially embraced by an outer edge portion of privacy screen 20, it will be understood that privacy screen 20 may be secured to frame sub-assembly 12 via numerous mechanisms that would be known to those with ordinary skill in the art having the present disclosure before them, such as non-threaded fasteners, threaded fasteners, snaps, buttons, rivets, clamps, adhesives, and/or stitching. Preferably, privacy screen 20 is releasably secured to frame sub-assembly 12 and may be washed and/or replaced as needed. Privacy screen 20 may be fabricated from, for example, any one of a number of materials, including, for example, leather, nylon, cloth, plastic, flexible materials, etcetera.

Ground-engaging wheels 22A and 22B are associated with frame sub-assembly 12 and are configured to controllably direct displacement of arcuately displaceable privacy screen assembly 10 in an arcuate path of travel such that a linear and/or arcuate force directed at arcuately displaceable privacy screen assembly 10 will result in arcuate displacement of the same. The arcuate displacement directed by ground-engaging wheels 22A and 22B follows an arc which is pre-determined, and therefore controlled, and results from the alignment of ground-engaging wheels 22A and 22B. In particular, ground engaging wheels 22A and 22B are offset from a parallel configuration relative to one another, which, in turn, facilitates controlled arcuate displacement of arcuately displaceable privacy screen assembly 10. Preferably, ground-engaging wheels 22A and 22B are configured in a fixed position, but it is contemplated that they may remain unfixed or fixable. Moreover, ground-engaging wheel 22A may be fixed in a substantially parallel position relative to first end 16A' of first substantially horizontal frame member 16A and second ground engaging wheel 22B may be fixed in a substantially parallel position relative to second end 16A" of first substantially horizontal frame member 16A. Preferably, ground-engaging wheels 22A and 22B are configured substantially inline relative to first substantially horizontal frame member 16A such that the ground-engaging wheels do not protrude well beyond frame sub-assembly 12 and lie substantially on the path of the pre-determined arc.

Figure 6:
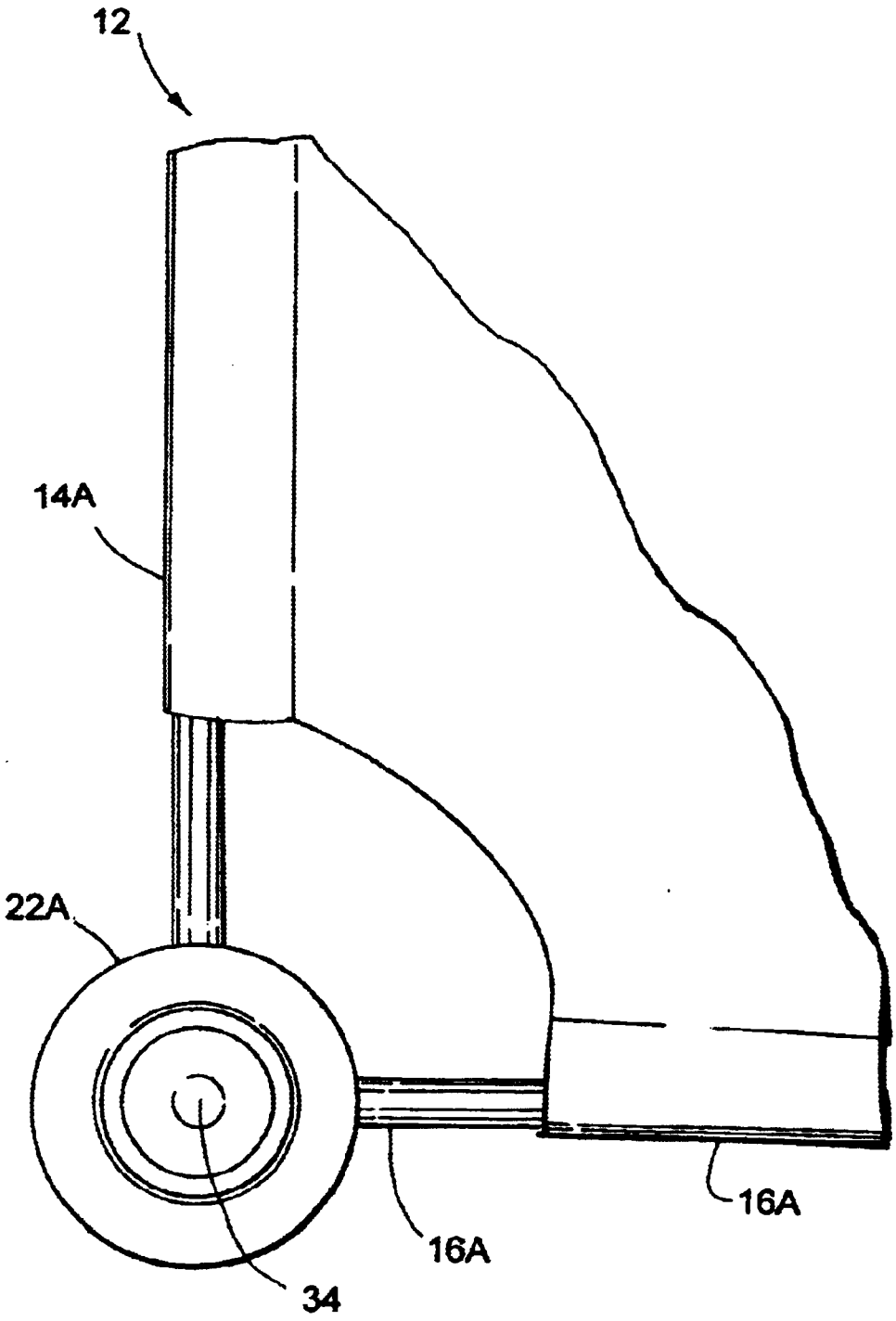
FIG. 6 of the drawings is a fragmented, perspective front view of an arcuately displaceable privacy screen assembly fabricated in accordance with the present invention showing, among other things, a ground-engaging wheel associated with the frame sub-assembly.
Figure 7:
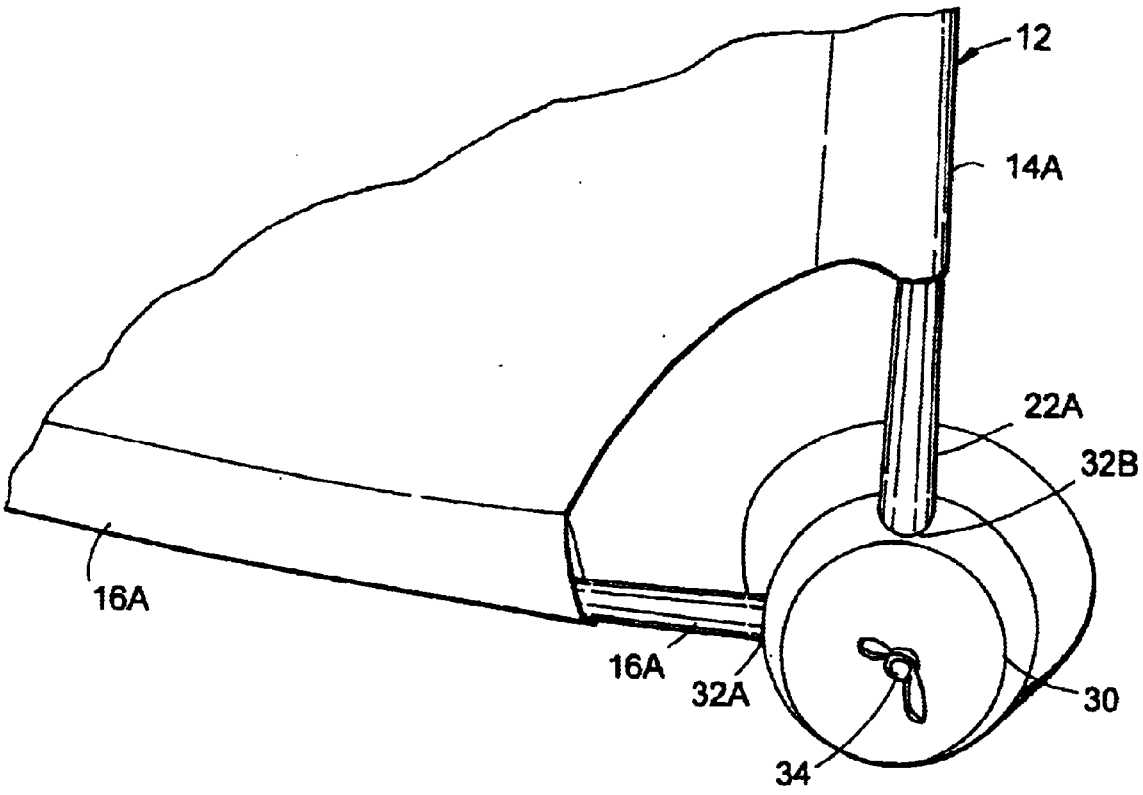
FIG. 7 of the drawings is a fragmented, perspective rear view of an arcuately displaceable privacy screen assembly fabricated in accordance with the present invention showing, among other things, a ground-engaging wheel associated with the frame sub-assembly.

Referring now to FIGS. 6 and 7, ground-engaging wheel 22A is associated with frame sub-assembly 12 via mounting member 30, which may comprise a variety of mounting mechanisms known to those skilled in the art with the present disclosure before them. For purposes of the present disclosure, mounting member 30 includes at least two mounting apertures 32A and 32B and wheel fastener 34. Mounting apertures 32A and 32B retain first substantially horizontal frame member 16A and first substantially vertical frame members 14A, respectively. Wheel fastener 34 secures ground-engaging wheel 22A to mounting member 30. For purposes of the present disclosure, wheel fastener 34 may comprise non-threaded fasteners, threaded fasteners, rivets, clamps, and/or any one of a number of fasteners that would be known to those with ordinary skill in the art having the present disclosure before them. It will be understood that ground-engaging wheel 22B is associated with frame sub-assembly 12 in an analogous manner as ground-ground engaging wheel 22A.

As is shown in FIGS. 1–5, the arcuately displaceable privacy screen assembly 10 may also comprise means for biasing the arcuately displaceable privacy screen assembly 10 in a substantially upright configuration, even when a force causes the privacy screen to tilt away from its substantially upright configuration (i.e. an approximately 90 degree angle to the ground) to a substantially non-upright configuration (i.e. an approximately 45 degree or greater angle to the ground). Indeed, the biasing means of arcuately displaceable privacy screen assembly 10 causes it to return to its substantially upright configuration. Such a means for biasing is collectively effected through the configuration of arcuately displaceable privacy screen assembly 10 and its resulting center of gravity being positioned proximate and/or toward a lower, central region 25 (see FIG. 5).

Figure 8:
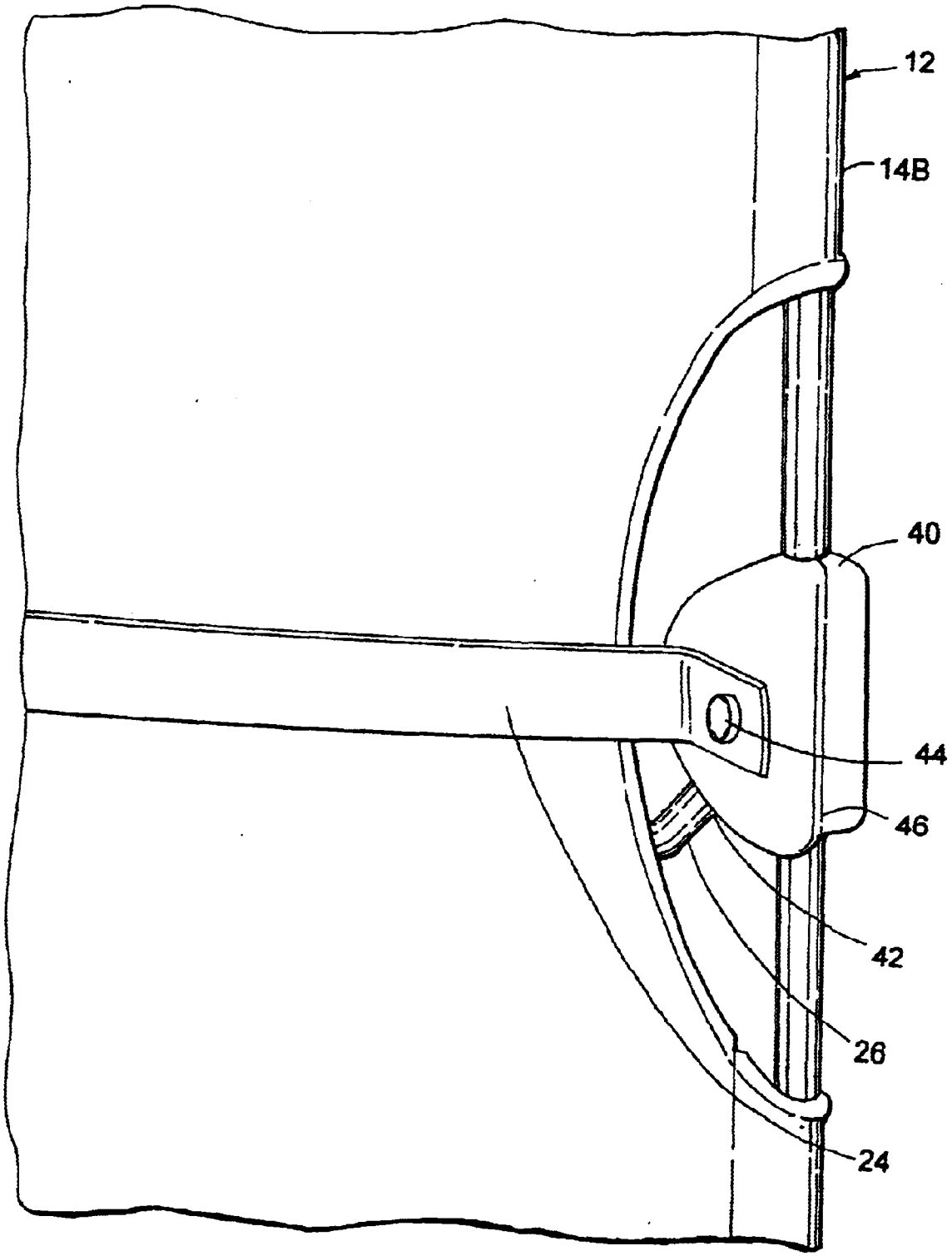
FIG. 8 of the drawings is a fragmented, perspective front view of an arcuately displaceable privacy screen assembly fabricated in accordance with the present invention showing, among other things, a handle, and a stabilizing member associated with the frame sub-assembly.

Referring now to FIGS. 1 and 8, collectively, handle 24 is associated with both first substantially vertical frame member 14A and second substantially vertical frame member 14B via mounting members 40. Mounting members 40 couple first and second substantially vertical frame members 14A and 14B, respectively, to handle 24. Mounting members 40 may comprise a variety of mounting mechanisms known to those skilled in the art with the present disclosure before them. For purposes of the present disclosure, mounting members 40 include at least one handle fastener 44 and C-shaped mounting channel 46. Handle fastener 44 secures handle 24 to first and second substantially vertical frame member 14A and 14B, respectively. For purposes of the present disclosure, handle fasteners 44 may comprise non-threaded fasteners, threaded fasteners, rivets, clamps, and/or any one of a number of fasteners that would be known to those with ordinary skill in the art having the present disclosure before them. Mounting channel 46 comprises a substantially C-shaped chamber which retains first or second substantially vertical frame members 14A or 14B. As can be seen in FIGS. 1 and 8, it is contemplated that mounting members 40 also include at least one mounting aperture 42 to retain a stabilizing member 26. Although FIG. 8 shows mounting member 40 securing handle 24 to second substantially vertical frame member 14B, it will be understood that mounting member 40 secures handle 24 to first substantially vertical frame member 14A by the same means using analogous elements and reference numbers.

Although not shown, it is also contemplated that handle 24 comprises an outer peripheral geometry to which attachments may be hung or otherwise secured to such as, for example, bins and/or holders for office and/or personal supplies.

Figure 5:
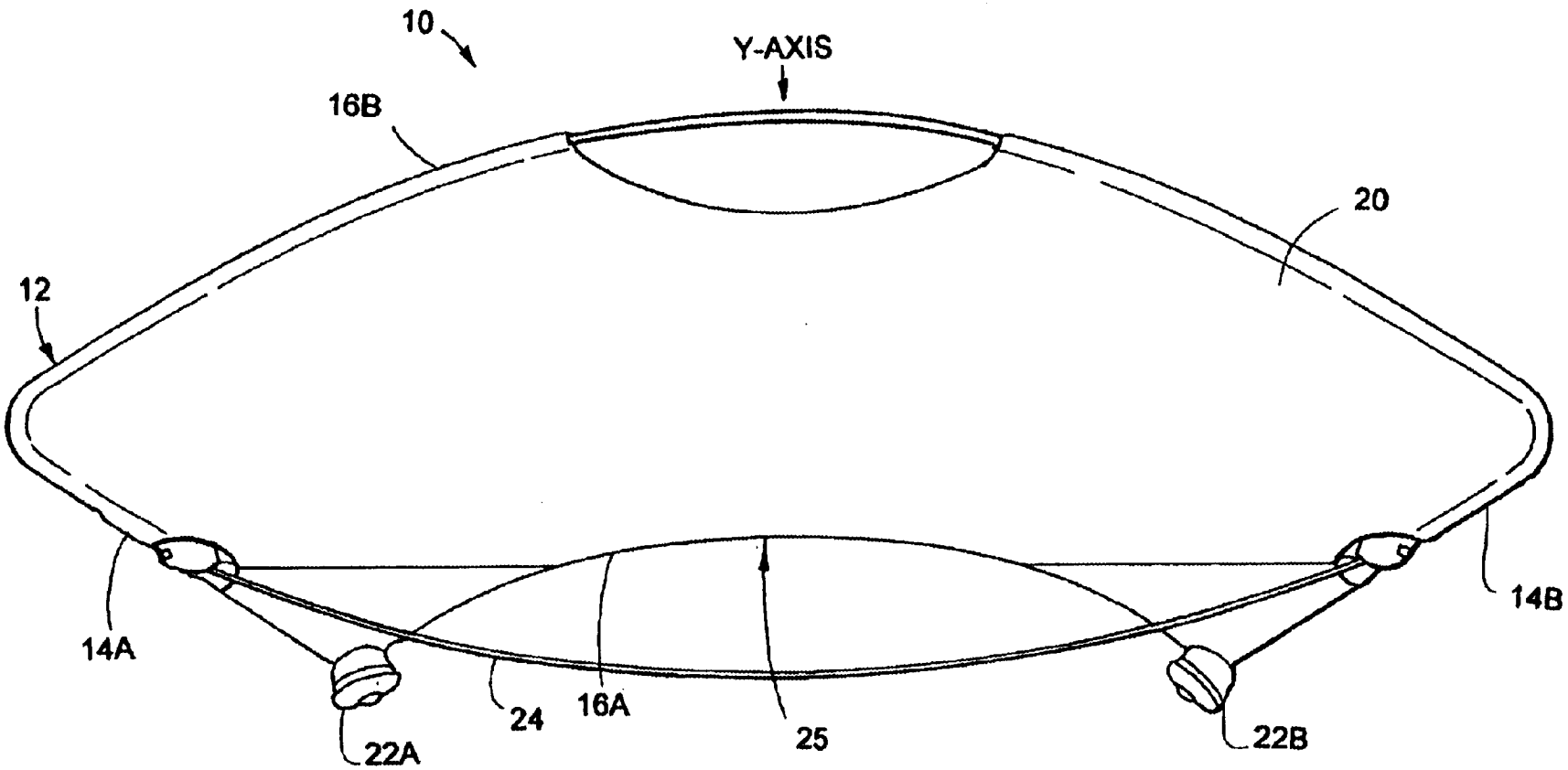
FIG. 5 of the drawings is an elevated perspective front view of an arcuately displaceable privacy screen assembly fabricated in accordance with the present invention.

Preferably, handle 24 and first substantially horizontal frame member 16A are cambered to, in turn, form an ogive when viewed from a y-axis of the same as is shown in FIGS. 1 and 5. Regardless of its ordinary meaning, the term "ogive" will herein be defined as a geometrical, bullet-shaped form resulting from the intersection of two curves that have generally the same or similar radii of curvature. As is shown in FIGS. 1–5, it is further contemplated that second substantially horizontal frame member 16B be cambered upward and/or to the rear of arcuately displaceable privacy screen assembly 10.

Figure 2:
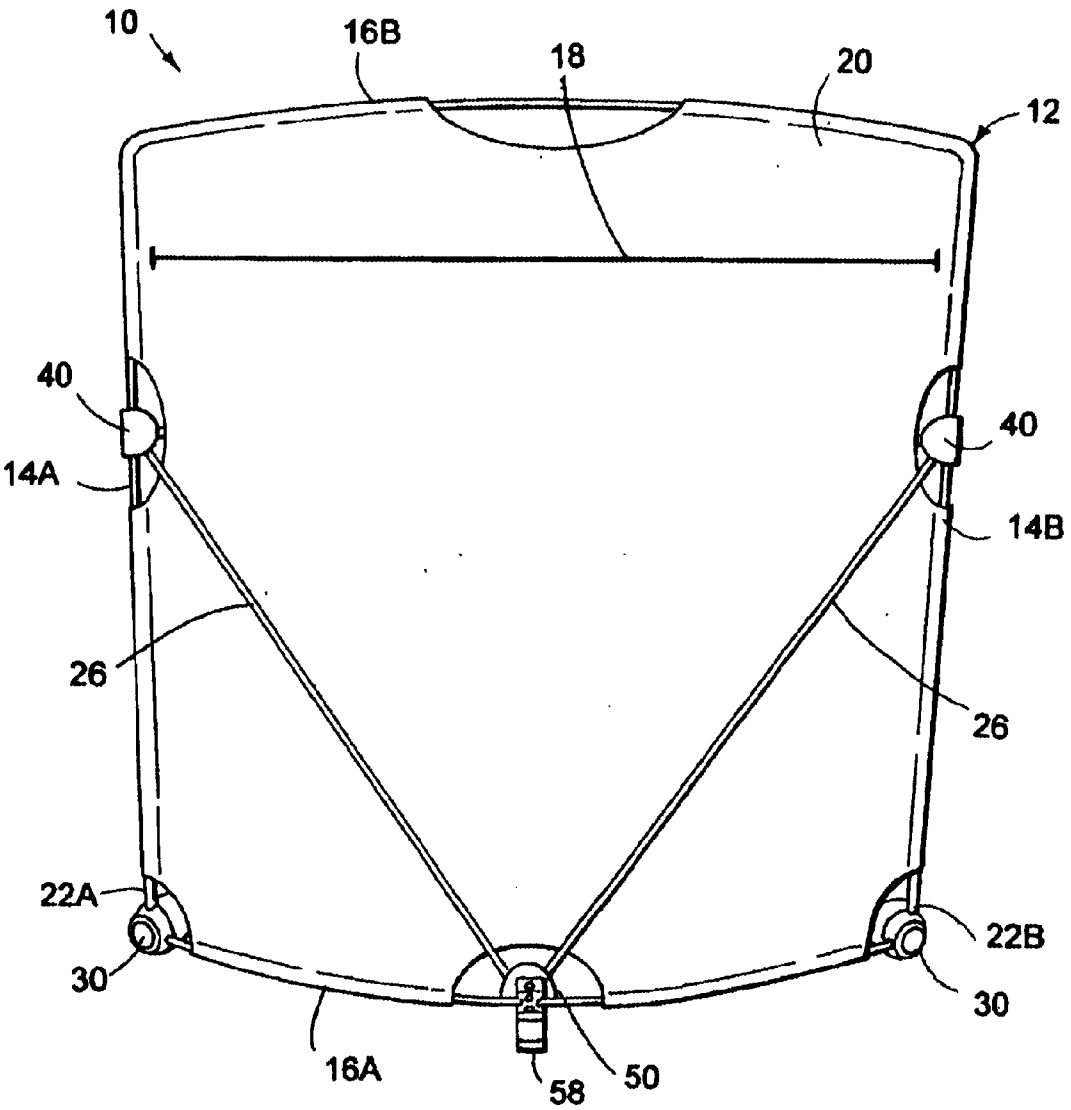
FIG. 2 of the drawings is a perspective rear view of an arcuately displaceable privacy screen assembly fabricated in accordance with the present invention.
Figure 3:
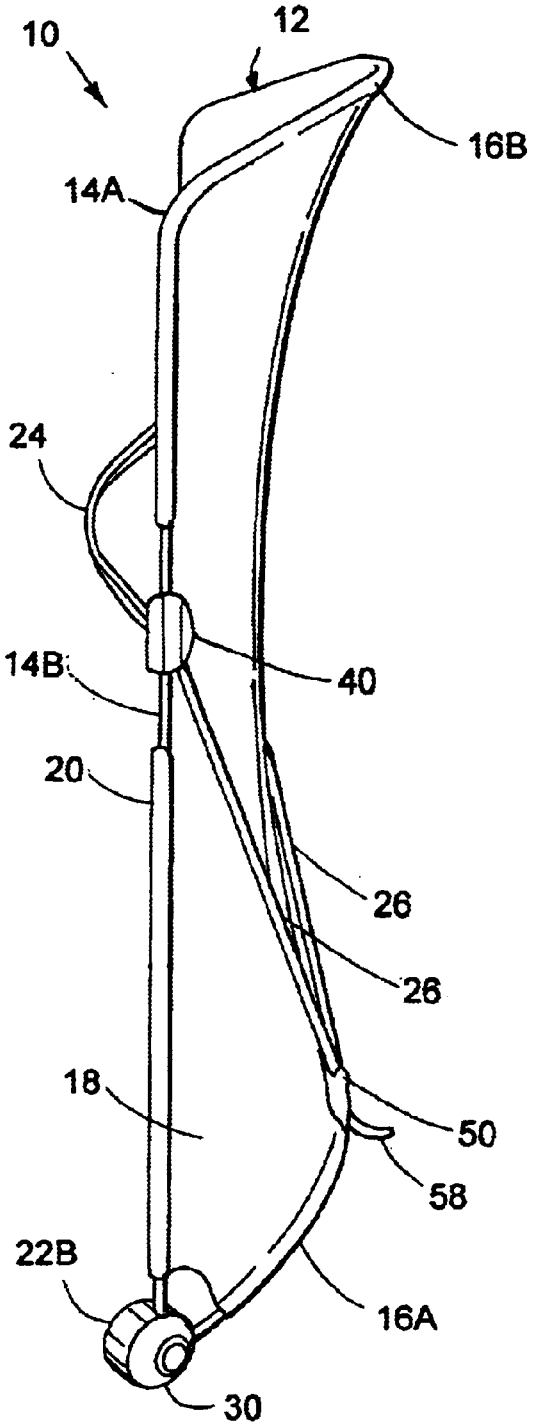
FIG. 3 of the drawings is a perspective side view of an arcuately displaceable privacy screen assembly fabricated in accordance with the present invention.
Figure 4:
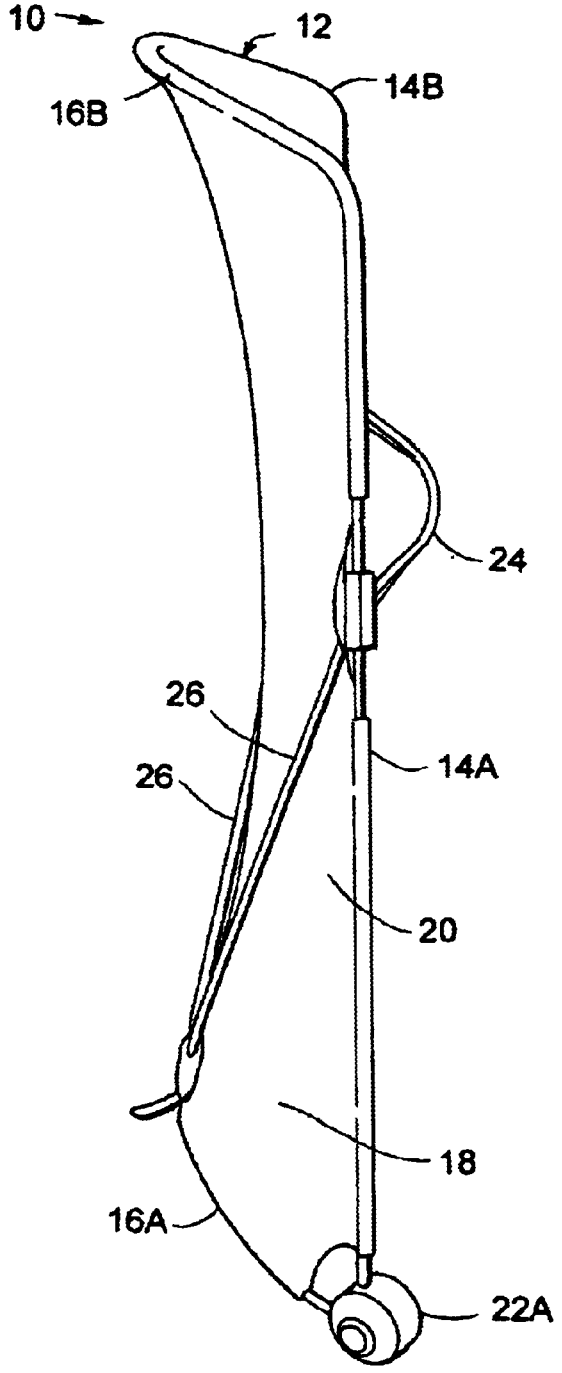
FIG. 4 of the drawings is a perspective side view of an arcuately displaceable privacy screen assembly fabricated in accordance with the present invention.
Figure 9:
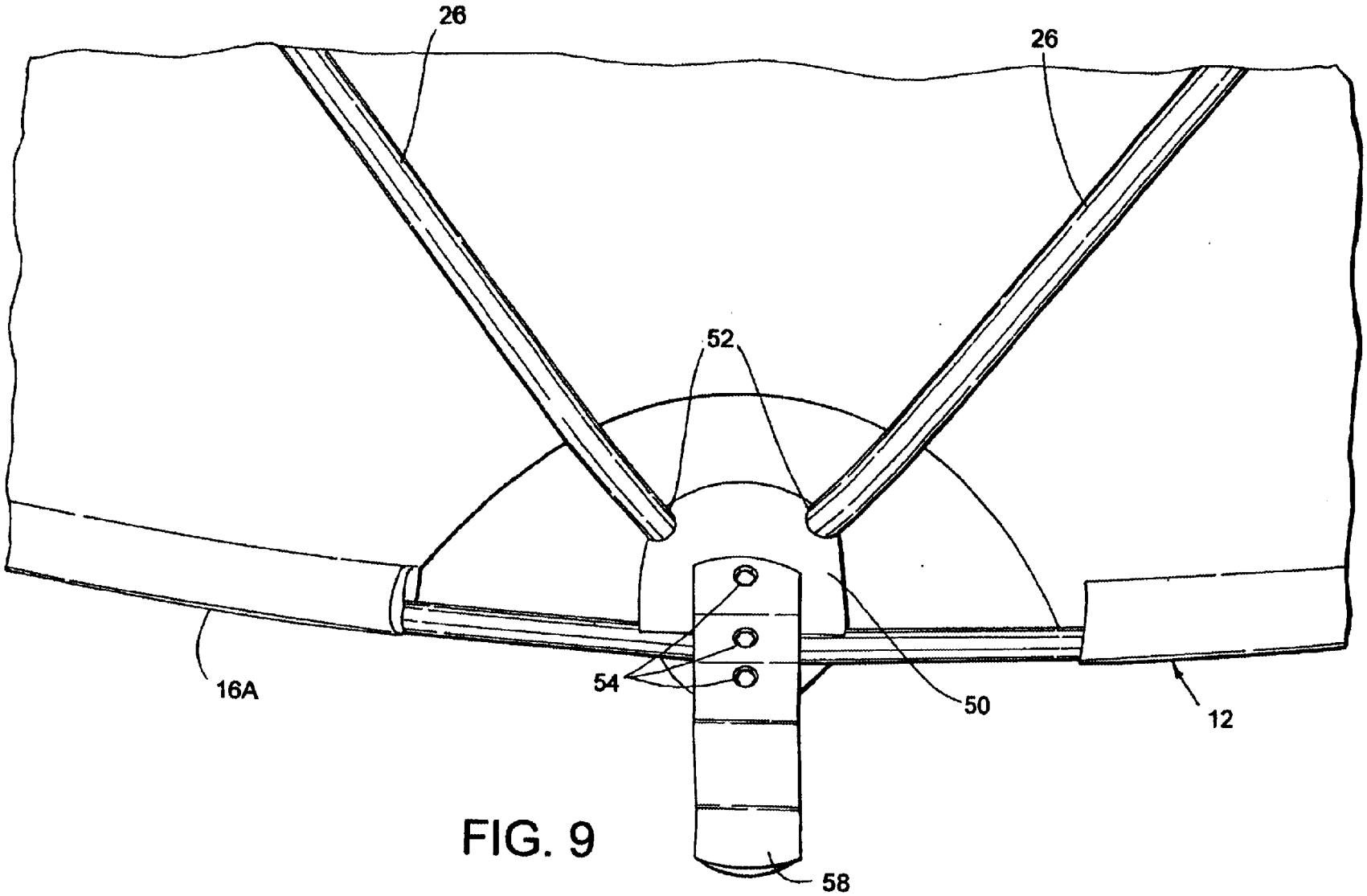
FIG. 9 of the drawings is a fragmented, perspective rear view of an arcuately displaceable privacy screen assembly fabricated in accordance with the present invention showing, among other things, a pair of stabilizing members and a kickstand associated with the frame sub-assembly.
Figure 10:
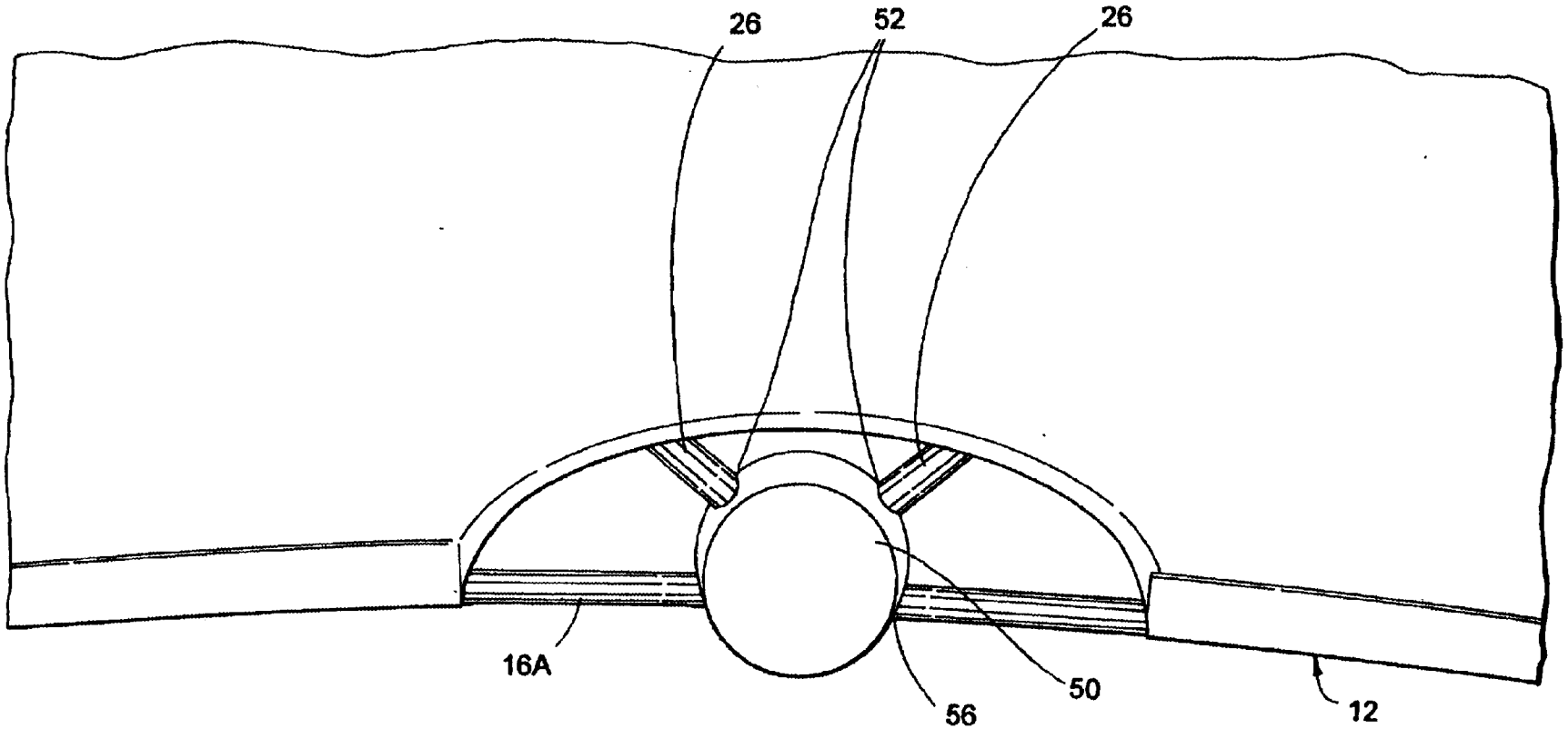
FIG. 10 of the drawings is a fragmented, perspective front view of an arcuately displaceable privacy screen assembly fabricated in accordance with the present invention showing, among other things, a pair of stabilizing members associated with the frame sub-assembly.

Referring to FIGS. 2, 9, and 10, stabilizing members 26 are associated with first substantially horizontal frame member 16A and first substantially vertical frame member 14A and first substantially horizontal frame member 16A and second substantially vertical frame member 14B via two of mounting member 50. Mounting member 50 may comprise a variety of mounting mechanisms known to those skilled in the art with the present disclosure before them. For purposes of the present disclosure, and as is shown in FIGS. 9 and 10, mounting member 50 includes at least one mounting aperture 52 and mounting channel 56. Mounting aperture 52 retains one or more stabilizing members 26, and mounting channel 56 retains first substantially horizontal frame member 16A. Stabilizing members 26 may comprise a cambered geometry, and may be fabricated from natural and/or synthetic resins, plastics, woods, metals, composites, and/or combinations thereof As is shown in FIGS. 2 and 9, a kickstand 58 may be associated with mounting member 50 and, in turn, first substantially horizontal frame member 16A via at least one mounting fastener 54. For purposes of the present disclosure, mounting fastener 54 may comprise non-threaded fasteners, threaded fasteners, rivets, clamps, and/or any one of a number of fasteners that would be known to those with ordinary skill in the art having the present disclosure before them. Although not shown, arcuately displaceable privacy screen assembly 10 may be fully functional with one stabilizing member 26. Such a stabilizing member may be configured as shown or, alternatively, secured via mounting members 40 to first and second substantially vertical frame members 14A and 14B, respectively.

Use of arcuately displaceable privacy screen assembly 10 is highly desirous because many conventional partitions and/or dividing panels are not conducive to arcuate displacement with substantial ease, safety, and convenience. Conventional partitions and/or dividing panels require the user to actuate the necessary arc of displacement needed when shifting such a privacy screen around the user or the user's work station. In addition, conventional partitions and/or dividing panels can be bulky, heavy, and/or difficult to position, and can present occupational and/or safety hazards in that they can be easily tipped over and/or their means for displacement, i.e. wheels and/or casters, typically protrude well beyond the base and appear to be easily tripped upon. In comparison, arcuately displaceable privacy screen assembly 10 enables a user to easily rotate such means for privacy around themselves or their work station and safely maintain a clean environment, convenient for storage or use of office supplies or one or more of arcuately displaceable privacy screen assembly 10 itself.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. An arcuately displaceable privacy screen assembly, comprising:

a substantially flat, arcuate frame sub-assembly having an internal aperture contained therein, wherein at least a portion of the internal aperture is covered with a privacy screen; and at least two ground engaging wheels associated with the frame sub-assembly, wherein the at least two ground engaging wheels are each disposed on two axles positioned at oblique angles relative to each other, and wherein the axis of rotation of the at least two ground engaging wheels are fixed in a substantially perpendicular orientation relative to the frame sub-assembly, and further wherein the at least two ground engaging wheels controllably direct displacement of the privacy screen in an arcuate path of travel.

2. The arcuately displaceable privacy screen assembly according to claim 1, wherein one of the at least two ground engaging wheels is fixed in a substantially parallel position relative to a first end of a first substantially horizontal frame member and a second ground engaging wheel is fixed in a substantially parallel position relative to a second end of the first substantially horizontal frame member.

3. The arcuately displaceable privacy screen assembly according to claim 2, wherein the at least two ground engaging wheels are configured substantially inline relative to the first substantially horizontal frame member.

4. The arcuately displaceable privacy screen assembly according to claim 1, further comprising at least one handle associated with both a first substantially vertical frame member and a second substantially vertical frame member.

5. The arcuately displaceable privacy screen assembly according to claim 4, wherein the at least one handle is cambered to, in turn, form an ogive with a first substantially horizontal frame member when viewed from a y-axis of the same.

6. The arcuately displaceable privacy screen assembly according to claim 1, further comprising at least one stabilizing member associated with the first substantially horizontal frame member and the first substantially vertical frame member.

7. The arcuately displaceable privacy screen assembly according to claim 1, further comprising at least one stabilizing member associated with a first substantially horizontal frame member and a first substantially vertical frame member.

8. An arcuately displaceable privacy screen assembly, comprising:

a substantially flat, arcuate frame sub-assembly having an internal aperture contained therein, wherein at least a potion of the internal aperture is covered wit a privacy screen;

at least two ground engaging wheels associated wit the frame sub-assembly, wherein the at least two ground engaging wheels are each disposed on two axles positioned at oblique angles relative to each other, and wherein the axis of rotation of the at least two ground engaging wheels is fixed in a substantially perpendicular orientation relative to the frame sub-assembly, and further wherein the at least two ground engaging wheels controllably direct displacement of the privacy screen in an arcuate path of travel;

at least one handle associated with both a first substantially vertical frame member and a second substantially vertical frame member; and at least one stabilizing member associated wit the first substantially horizontal frame member and the first substantially vertical frame member.

9. An arcuately displaceable privacy screen assembly, comprising:

a substantially flat, arcuate frame sub-assembly, wherein the frame sub-assembly includes first and second substantially vertical frame members and first and second substantially horizontal frame members, wherein both of the first and second substantially horizontal frame members are cambered, and wherein the first and second substantially vertical frame members and the first and second substantially horizontal frame members collectively define an internal aperture, wherein at least a portion of the internal aperture is covered with a privacy screen; and at least two ground engaging wheels associated with the frame sub-assembly, wherein the at least two ground engaging wheels are each disposed on two axles positioned at oblique angles relative to each other, and wherein the axis of rotation of the at least two ground engaging wheels are fixed in a substantially perpendicular orientation relative to the frame sub-assembly, and further wherein the at least two ground engaging wheels controllably direct displacement of the privacy screen in an arcuate path of travel.

10. The arcuately displaceable privacy screen assembly according to claim 9, wherein the at least two ground engaging wheels are configured substantially inline relative to the first substantially horizontal frame member.

11. The arcuately displaceable privacy screen assembly according to claim 9, further comprising at least one handle associated with both the first substantially vertical frame member and the second substantially vertical frame member.

12. The arcuately displaceable privacy screen assembly according to claim 11, wherein the at least one handle is cambered to, in turn, form an ogive with the first substantially horizontal frame member when viewed from a y-axis of the same.

13. The arcuately displaceable privacy screen assembly according to claim 9, further comprising at least one stabilizing member associated with the first substantially horizontal frame member and the first substantially vertical frame member.

14. An arcuately displaceable privacy screen assembly, comprising:

a substantially flat arcuate frame sub-assembly, wherein the frame sub-assembly includes first and second substantially vertical frame members and first and second substantially horizontal frame members, wherein both of the first and second substantially horizontal frame members are cambered, and wherein the first and second substantially vertical frame members and the first and second substantially horizontal frame members collectively define an internal aperture, wherein at least a portion of the internal aperture is covered with a privacy screen;

at least two ground engaging wheels associated with the frame sub-assembly, wherein the at least two ground engaging wheels are each disposed on two axles positioned at oblique angles relative to each other, and wherein the axis of rotation of the at least two ground engaging wheels are fixed in a substantially perpendicular orientation relative to the frame sub-assembly, and further wherein the at least two ground engaging wheels controllably direct displacement of the privacy screen in an arcuate path of travel;

at least one handle associated with both the first substantially vertical frame member and the second substantially vertical frame member, wherein the at least one handle is cambered to, in turn, form an ogive with the first substantially horizontal frame member when viewed from a y-axis of the same; and a first stabilizing member associated with the first substantially horizontal frame member and the first substantially vertical frame member and a second stabilizing member associated with the first substantially horizontal frame member and the second substantially vertical frame member.

* * * * *